United States Patent [19]

Hon Man

[11] 4,113,336

[45] Sep. 12, 1978

[54] SAFETY ELECTRIC RECEPTACLE AND THE PLUG

[76] Inventor: Luk Hon Man, Yung Ho Chen, Taipei Hsien, Taiwan

[21] Appl. No.: 605,767

[22] Filed: Aug. 18, 1975

[51] Int. Cl.[2] ..... H01R 13/54

[52] U.S. Cl. ..... 339/75 P; 339/176 P

[58] Field of Search ..... 339/75, 75 P, 41, 42, 339/78, 88 R, 166 R, 176 P, 187, 188 R, 22 B

[56] References Cited

U.S. PATENT DOCUMENTS

| | | | |
|---|---|---|---|
| 2,926,327 | 2/1960 | Metelli | 339/41 |
| 3,407,376 | 10/1968 | Martin | 339/41 |
| 3,775,726 | 11/1973 | Gress | 339/75 P X |

*Primary Examiner*—Roy Lake
*Assistant Examiner*—E. F. Desmond
*Attorney, Agent, or Firm*—Holman & Stern

[57] ABSTRACT

The safety electric receptacle and plug by which the completion of an electrical circuit is impossible until the plug makes a rotation of lateral translation after inserting into receptacle is disclosed. The apparatus utilizes a plug on which two blade conductors make a perpendicular position with the plug. Two conductors in the receptacle are installed at the place where don't touch with the inserted plug directly at first. There are two implementations of this device. First, the inserted plug rotates in the receptacle to conduct the electric current. Second, the inserted plug translates laterally in the receptacle to conduct the electric current. So that until predetermined operation has been performed, this apparatus will not conduct electricity. Hence, a child who inserts some conductive article into the receptacle can be kept in safety situation. Just only one sort of plug is necessary in using these two different receptacles. The insertion of the plug don't be easily pulled from the receptacle in this invention for avoiding the unintentionally breaking an electrical circuit.

2 Claims, 14 Drawing Figures

SAFETY ELECTRIC RECEPTACLE AND THE PLUG

BRIEF SUMMARY OF THE INVENTION

This invention relates to safety electrical receptacle and plug which will not conduct the electricity before the inserted plug performing a rotation or lateral translation in the receptacle. Conventional electrical receptacles are dangerous to small children who always like to stick metal objects into the receptacle sockets. Also, an improper insertion of an electrical plug in a conventional receptacle can cause a dangerous arcing of electrical electrical current which can burn receptacle or injure the electrical equipments on which the plug is used. Standard plug are easily pulled from conventional electrical receptacles and this may unintentionally break an electrical circuit supplying current. Besides, having to repeatedly re-insert such a plug can be both time consuming and annoying.

The purpose of the present invention is to provide an electrical receptacle designed with safety as a prime consideration. Furthermore, to combining tightly the plug with the receptacle can be attained by this invention. For accomplishing these objects, the plug with two blade conductors in perpendicular position has to take a rotation or a lateral translation after inserting into the receptacle for conducting electricity. So that the plug is locked firmly in the receptacle. Similarly, before pulling the plug of this invention from the receptacle, it is necessary to rotate or to translate laterally the plug in the reverse process against the inserting. So that the separation of the plug from the receptacle is not as easy as that of conventional receptacle. The arcing of electrical current caused by improper insertion of a plug is impossible for this invention.

DETAILED DESCRIPTION

Figure 1:
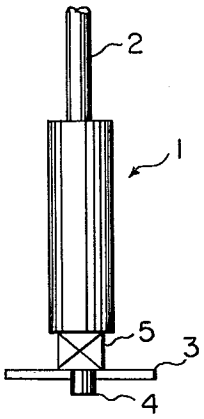
FIG. 1 is the side view of the plug used in this invention.
Figure 2:
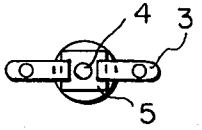
FIG. 2 is the top view of the plug used in this invention.
Figure 3:
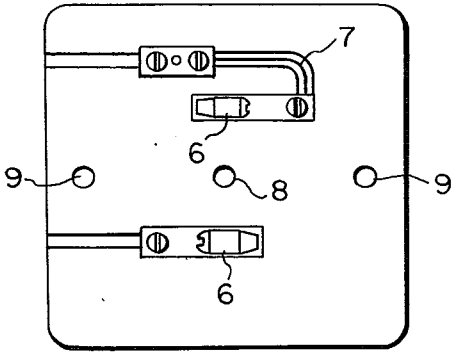
FIG. 3 is the bottom plate of the receptacle on which two conductors are arranged in such position that enabling the inserted plug to rotate to conduct electricity.
Figure 4:
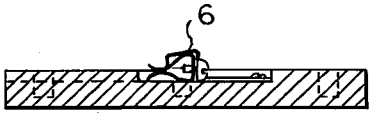
FIG. 4 is the side view of FIG. 3.
Figure 5:
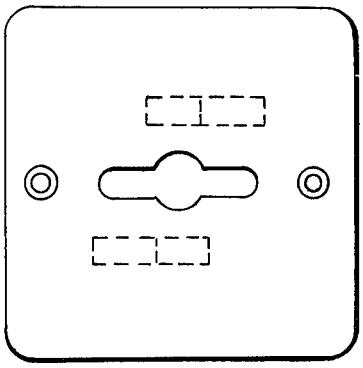
FIG. 5 is the cover of the bottom plate in FIG. 3.
Figure 6:
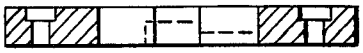
FIG. 6 is the side view of FIG. 5.
Figure 7:
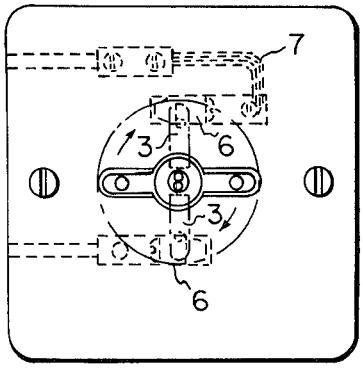
FIG. 7 is perspective view of the combination of the plug with the receptacle of FIG. 3.
Figure 8:
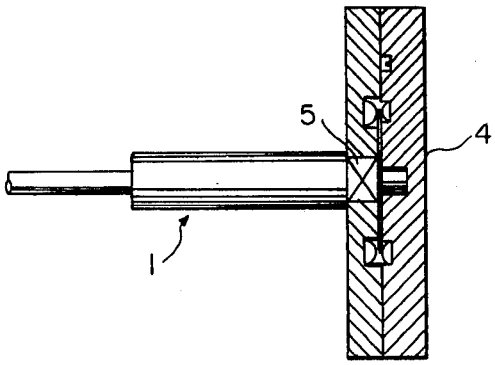
FIG. 8 is the side view to illustrate the combination of the plug and the receptacle of FIG. 3.

With reference now to the drawings, the plug 1 of this invention has a cable 2 at a rear portion of the plug and two metal blade conductors 3 a front portion, so that electrical current can be conducted through these two blade conductors into the wires in the cable. At the front of the plug, there is a round head 4 and a square head 5. Two blade conductors 3 are perpendicular with the plug and point in opposite directions. This sort of plug 1 can be used to fit two implementations of receptacle of this invention. The first implementation of the receptacle has a bottom plate, as shown in FIG. 3, on which two conductors 6 are installed in the symmetrical position. One of them connects with a fuse 7. The hole 8 is formed at the center of the bottom plate to fit the round head 4 of the plug 1, such that the plug can rotate around the round head 4 after it has been inserted into the receptacle, connecting with the conductors 6. The holes 9 are formed on the bottom plate for attaching the bottom plate with the cover. As shown in FIG. 5, a specially designed groove is opened at the center of the cover to fit the insertion of the plug 1.

Figure 11:
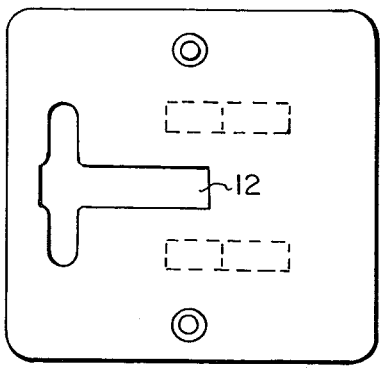
FIG. 11 is the cover of bottom plate in FIG. 9.
Figure 12:
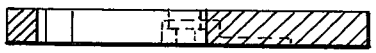
FIG. 12 is the side view of the FIG. 11.
Figure 9:
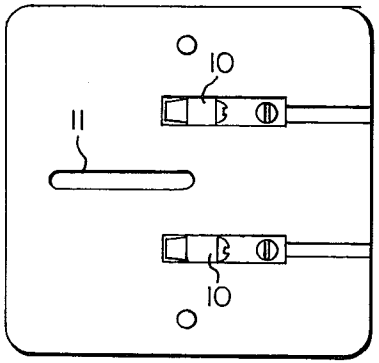
FIG. 9 is the bottom plate of the receptacle on which two conductors are arranged in such position that enabling the plug to translate laterally for conducting electricity.
Figure 10:
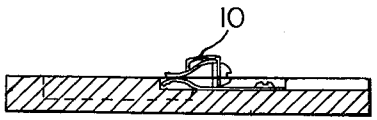
FIG. 10 is the side view of FIG. 9.
Figure 14:
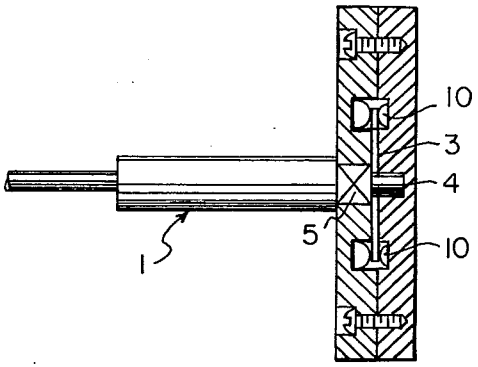
FIG. 14 is the side view to illustrate the combination of the plug and the receptacle in FIG. 9.
Figure 13:
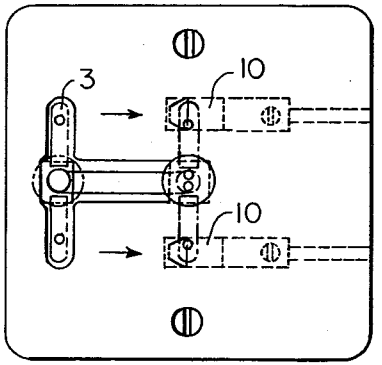
FIG. 13 is the perspective view to illustrate the combination of the plug and the receptacle of FIG. 9.

The second implementation of the invention relates to the bottom plate of the receptacle in which the plug 1 translates laterally after it has been inserted into the receptacle for conducting the electricity. As shown in FIG. 9, two conductors 10 are attached to the bottom plate. The groove 11 is formed to fit the round head 4 of the plug 1. FIG. 11 shows the cover, on which a "T" groove is formed with with such that the square head 5 of the plug 1 can be laterally translated. Consequently, only one sort of plug is necessary for these two different receptacles.

I claim:

1. A safety electric receptacle and plug assembly comprising:

a plug comprising two knife blade conductors in a perpendicular position with said plug at its one end, a round head at said end and a square head behind closely said round head;

said two blade conductors pointing out between said round head and said square head toward opposite directions;

a receptacle comprising a bottom plate and a cover;

said bottom plate including two conductors in a symetrical arrangement for engaging said knife blade conductors when said plug is rotated;

said cover includes an aperture for insertion of said plug into said aperture and for permitting rotation of the plug allowing insertion of said knife blade conductors into said bottom plate conductors.

2. A safety electric receptacle and plug assembly comprising:

a plug comprising two knife blade conductors in a perpendicular position with said plug at its one end, a round head at said end and a square head adjacent thereto;

said two blade conductors pointing out between said round head and said square head toward opposite directions;

a receptacle comprising a bottom plate and a cover;

said bottom plate including two conductors and a groove into which said round head of said plug can be slidably inserted;

said cover including a "T" shaped aperture for permitting said square head portion of said plug to be translated laterally therein and for permitting said knife blade conductors to be inserted into said bottom plate conductors during said lateral translation.

* * * * *